US010294445B2

(12) United States Patent
Brandt Sanz

(10) Patent No.: US 10,294,445 B2
(45) Date of Patent: May 21, 2019

(54) PROCESS FOR MAKING UNITIZED DOSE POUCHES WITH MODIFICATIONS AT A SEAL REGION

(71) Applicant: The Procter & Gamble Company, Cincinnati, OH (US)

(72) Inventor: Miguel Brandt Sanz, Tervuren (BE)

(73) Assignee: The Procter & Gamble Company, Cincinnati, OH (US)

( * ) Notice: Subject to any disclaimer, the term of this patent is extended or adjusted under 35 U.S.C. 154(b) by 202 days.

(21) Appl. No.: 15/254,152

(22) Filed: Sep. 1, 2016

(65) Prior Publication Data

US 2018/0057776 A1 Mar. 1, 2018

(51) Int. Cl.

| | |
|---|---|
| ***C11D 17/04*** | (2006.01) |
| ***B65B 9/02*** | (2006.01) |
| ***C11D 17/00*** | (2006.01) |
| ***B65B 61/06*** | (2006.01) |
| ***B65D 65/46*** | (2006.01) |
| ***B65D 75/30*** | (2006.01) |

(52) U.S. Cl.

CPC ..... *C11D 17/00* (2013.01); *B65B 9/023* (2013.01); *B65B 61/06* (2013.01); *B65D 65/46* (2013.01); *B65D 75/30* (2013.01); *C11D 17/042* (2013.01); *C11D 17/043* (2013.01); *C11D 17/045* (2013.01)

(58) Field of Classification Search

None

See application file for complete search history.

(56) References Cited

U.S. PATENT DOCUMENTS

| | | | | |
|---|---|---|---|---|
| 3,025,848 | A | 3/1962 | Malgesini | |
| 4,743,123 | A | 5/1988 | Legters et al. | |
| 5,534,178 | A * | 7/1996 | Bailly | C11D 17/044 510/224 |
| 5,783,541 | A | 7/1998 | Tack et al. | |
| 6,624,130 | B2 | 9/2003 | Giblin | |
| 6,995,126 | B2 | 2/2006 | Perkis et al. | |
| 7,127,874 | B2 | 10/2006 | Viltro et al. | |
| 7,386,971 | B2 | 6/2008 | Catlin et al. | |
| 7,464,519 | B2 | 12/2008 | Fisher et al. | |
| 7,677,015 | B2 | 3/2010 | Kroese et al. | |
| 8,066,818 | B2 | 11/2011 | Brooker et al. | |
| 9,550,304 | B2 | 1/2017 | Khalaf et al. | |
| 2002/0086806 | A1 * | 7/2002 | Giblin | B65D 75/5811 510/296 |
| 2003/0108705 | A1 | 6/2003 | Duffield | |
| 2006/0213801 | A1 | 9/2006 | Karaoren | |

(Continued)

FOREIGN PATENT DOCUMENTS

| | | | |
|---|---|---|---|
| EP | 0700989 | A1 * | 3/1996 |
| EP | 3025848 | A1 * | 6/2016 |
| WO | WO 03/062085 | A1 | 7/2003 |

OTHER PUBLICATIONS

PCT Search Report for appl. PCT/US2017/048525, dated Nov. 8, 2017, 14 pages.

*Primary Examiner* — Lorna M Douyon

(74) *Attorney, Agent, or Firm* — Gregory S. Darley-Emerson

(57) ABSTRACT

Processes for making unitized dose pouches that have improved water solubility due to modifications at a seal region of the pouch, such as perforations. Unitized dose pouches having modifications at a seal region. Process of treating a fabric.

11 Claims, 10 Drawing Sheets

(56) References Cited

U.S. PATENT DOCUMENTS

| | | | | |
|---|---|---|---|---|
| 2011/0186468 | A1* | 8/2011 | Denome | B65D 65/46 206/524.7 |
| 2011/0257059 | A1 | 10/2011 | Somerville Roberts et al. | |
| 2012/0294969 | A1 | 11/2012 | Koch et al. | |
| 2014/0336029 | A1 | 11/2014 | Mirle et al. | |
| 2015/0360837 | A1* | 12/2015 | Perez-Prat Vinuesa | C11D 17/042 206/524.7 |
| 2016/0017264 | A1* | 1/2016 | Cumming | C11D 17/042 206/525 |
| 2016/0340068 | A1* | 11/2016 | Brandt Sanz | B65B 47/08 |

* cited by examiner

PROCESS FOR MAKING UNITIZED DOSE POUCHES WITH MODIFICATIONS AT A SEAL REGION

FIELD OF THE INVENTION

The present disclosure relates to processes for making unitized dose pouches having improved water solubility. The present disclosure further relates to unitized dose pouches.

BACKGROUND OF THE INVENTION

Unitized dose pouches provide consumers with a convenient way to dose certain compositions, such as household care compositions such as laundry detergent. Such pouches are often formed from water-soluble films. Typically, at least two films are sealed together to form a compartment that contains the desired composition. When the pouch is placed in water, the films dissolve and the composition is released.

This sealing process, however, may lead to a plurality of film layers at the seal regions, which may be present as a flange or a fin projecting from a periphery of the compartment. The plurality of layers can lead to decreased dissolution, resulting in undissolved film that remains after use, for example on fabrics, and consequently an unpleasant consumer experience.

There is a need for unitized dose pouches that have improved water solubility, particularly at the seal regions.

SUMMARY OF THE INVENTION

The present disclosure relates to processes for making unitized dose pouches having improved water solubility.

The present disclosure relates to a process that includes the steps of: providing a web that includes at least a first water-soluble film and a second water-soluble film, the first and second water-soluble films being joined at seal regions, where the first film, the second film, and the seal regions define a plurality of sealed compartments, the sealed compartments containing at least one composition; providing a plurality of modifications to the seal region, the modifications being selected from perforations, indentations, and combinations thereof; and cutting the web at the seal regions to form a plurality of unitized dose pouches, each pouch comprising at least one sealed compartment.

The present disclosure further relates to unitized dose pouches. The unitized dose pouch may include at least a first water-soluble film and a second water-soluble film joined at a seal region to form at least one compartment therebetween, the at least one compartment containing a liquid composition, the first and/or the second film comprising perforations at the seal region and no perforations at the compartment.

BRIEF DESCRIPTION OF THE DRAWINGS

The figures herein are illustrative in nature and are not intended to be limiting.

DETAILED DESCRIPTION OF THE INVENTION

Figure 1:
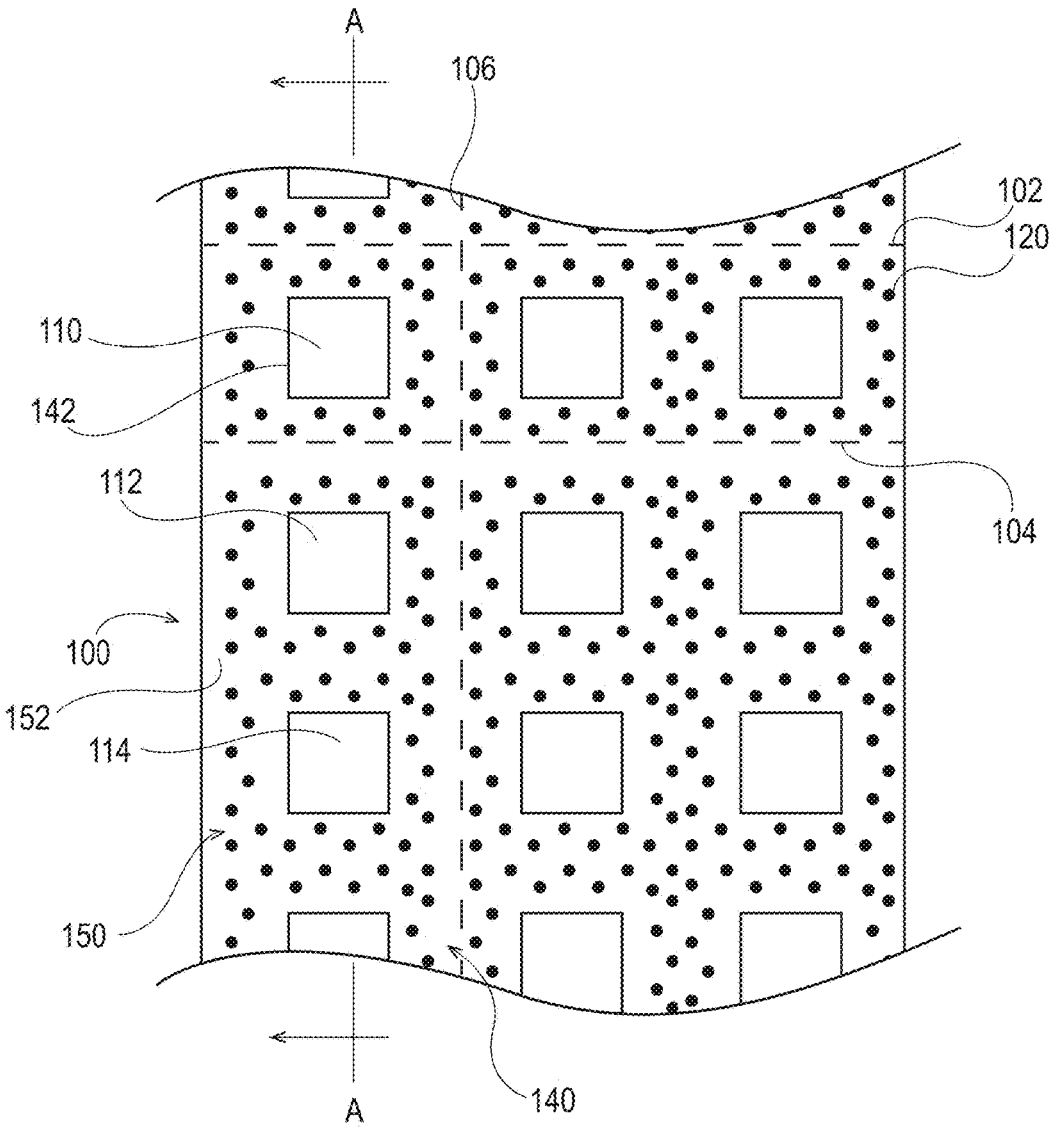
FIG. 1 shows a web according to the present disclosure.

The present disclosure relates to processes for making unitized dose pouches having improved water solubility. It has been found that modifying the seal region of the pouches with perforations, indentations, or combinations thereof, preferably perforations, can improve the dissolution of the pouches, particularly the seal region.

Additionally, it has been found that modifying a web of film after at least two films have been joined but before the resulting compartments have been separated into individual pouches provides processing and simplification advantages. For example, modifying the web of joined films allows the modification step to be performed in a single step, rather than modifying each film individually, thereby reducing complexity as well as space and capital requirements. Additionally, modifying the web of joined films facilitates registration or positioning of the modifications at the seal region, thereby avoiding accidental modification of the compartment area, which would lead to leaking pouches and/or increased ingress of water; water may lead to caking of granular compositions, undesired activation or degradation of certain chemistries contained therein, or loss of pouch integrity. Finally, attempting to modify the seal regions of individual pouches after they have been separated from the web would provide other challenges; for example, upon being cut apart from the rest of the web, the seal regions of the pouches contract once tension is released and may become curled or wavy, making them difficult to modify in the manner described herein.

The processes and pouches resulting from such processes are described in more detail below.

As used herein, the articles "a" and "an" when used in a claim, are understood to mean one or more of what is claimed or described. As used herein, the terms "include," "includes," and "including" are meant to be non-limiting. The compositions of the present disclosure can comprise, consist essentially of, or consist of, the components of the present disclosure.

The terms "substantially free of" or "substantially free from" may be used herein. This means that the indicated material is at the very minimum not deliberately added to the composition to form part of it, or, preferably, is not present at analytically detectable levels. It is meant to include compositions whereby the indicated material is present only as an impurity in one of the other materials deliberately included. The indicated material may be present, if at all, at a level of less than 1%, or less than 0.1%, or less than 0.01%, or even 0%, by weight of the composition.

As used herein the phrase "fabric care composition" includes compositions and formulations designed for treating fabric. Such compositions include but are not limited to, laundry cleaning compositions and detergents, fabric softening compositions, fabric enhancing compositions, fabric freshening compositions, laundry prewash, laundry pretreat, laundry additives, spray products, dry cleaning agent or composition, laundry rinse additive, wash additive, post-rinse fabric treatment, ironing aid, unit dose formulation, delayed delivery formulation, detergent contained on or in a porous substrate or nonwoven sheet, and other suitable forms that may be apparent to one skilled in the art in view of the teachings herein. Such compositions may be used as a pre-laundering treatment, a post-laundering treatment, or may be added during the rinse or wash cycle of the laundering operation.

Unless otherwise noted, all component or composition levels are in reference to the active portion of that component or composition, and are exclusive of impurities, for example, residual solvents or by-products, which may be present in commercially available sources of such components or compositions.

All temperatures herein are in degrees Celsius (° C.) unless otherwise indicated. Unless otherwise specified, all measurements herein are conducted at 20° C. and under the atmospheric pressure.

In all embodiments of the present disclosure, all percentages are by weight of the total composition, unless specifically stated otherwise. All ratios are weight ratios, unless specifically stated otherwise.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Process for Making Unitized Dose Pouches

The present disclosure relates to a process for making unitized dose pouches that have improved solubility, particularly at seal regions of the pouches. It has been found that modifying the seal regions with modifications selected from perforations, indentations, or combinations thereof, preferably perforations, results in improved dissolution. Furthermore, it has been found that a particular order of operations, namely where the modifications are added after the films have been joined to form compartments but before the web is separated (e.g., cut) into individual pouches provides for a simpler manufacturing process.

Figure 2:
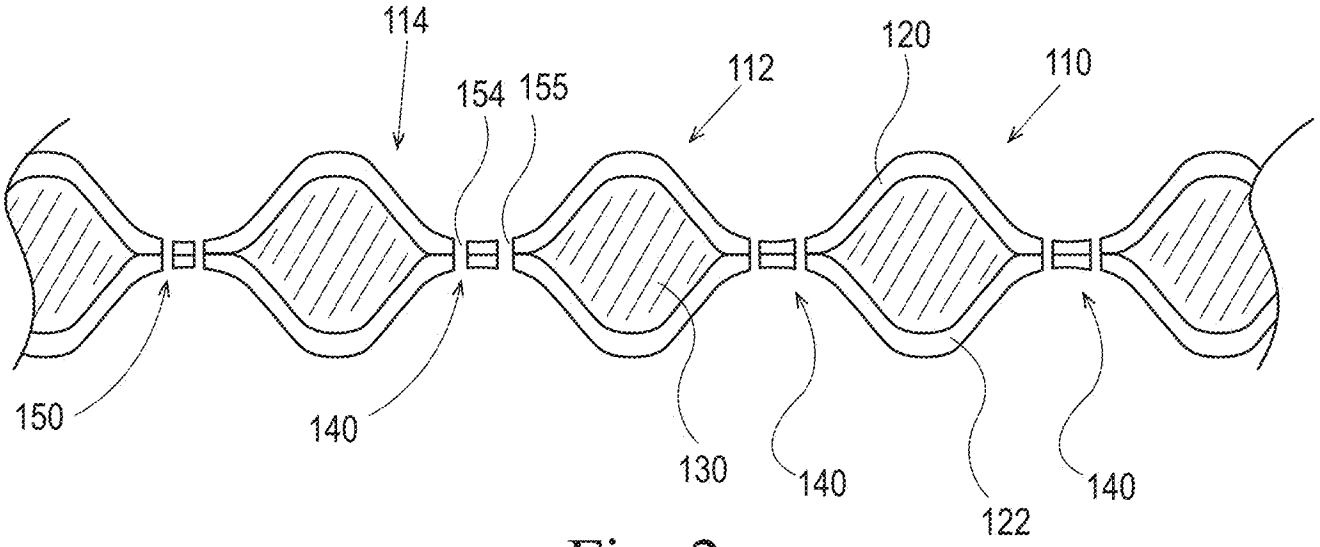
FIG. 2 shows a cross-sectional view of the web of FIG. 1, taken at line A-A.

The processes of the present disclosure may include the step of providing a web. FIG. 1 shows a top plan view of a suitable web 100, and FIG. 2 shows a cross-section view of the web 100 of FIG. 1, taken at line A-A. The web 100 may container a plurality of compartments 110, 112, each of which may contain a composition 130. At least some of the compartments 110, 112 may be separated, for example along cut lines 102, 104, 106, as described below, to form unitized dose pouches 200. The web 100 may comprise at least a first water-soluble film 120 and a second water-soluble film 122. The web 100 may further comprise a third water-soluble film 124. Suitable films are described in more detail below.

The first and second films 120, 122 may be joined, for example at seal regions 140. Suitable joining methods may include heat sealing, solvent sealing, pressure sealing, ultrasonic sealing, pressure sealing, laser sealing or a combination thereof. Solvent sealing may include the application of a suitable solvent to one or both films 120, 122, where suitable solvents may include water, an aqueous solution (including aqueous solutions comprising dissolved water soluble film and/or dissolved water-soluble polymer, preferably polyvinyl alcohol polymer or copolymer), an organic solvent, or combinations thereof.

As shown in FIGS. 1 and 2, the first water-soluble film 120 and the second water-soluble film 122 further define a plurality of sealed compartments 110, 112, 114 of the web 100. The sealed compartments may have a periphery 142 adjacent the seal region 140. The sealed compartments 110, 112, 114 may each have an internal volume.

The sealed compartments 110, 112, 114 may each contain at least one composition 130 in the internal volume. The composition 130 may be a liquid, gel, or solid composition. The composition 130 may be a household care composition. The composition may contain from about 5% to about 60%, by weight of the composition, of surfactant. Suitable compositions are described in more detail below.

Different compartments may contain different compositions. The plurality of sealed compartments may comprise first compartments that contain a first composition, and wherein the plurality of sealed compartment may further comprise second compartments that contain a second composition, where the second composition is different than the first composition.

The process may include the following steps in order to provide the web 100. For example, the process may comprise the step of providing the first film 120, forming a plurality of cavities in the first film, providing a composition to the plurality of cavities, and joining the second film 122 to the first film 120 to provide the web 100. The processes, or independent parts of the processes, of the present disclosure may be continuous or intermittent, preferably continuous. The plurality of cavities may be formed by providing the first film 120 into a mold to form the cavity. Typically, the cavities correspond to unit dose articles 200 that will be formed. A unit dose article 200 may be formed from one cavity or from a plurality of cavities.

The web 100 and/or cavities may be made by thermoforming, vacuum-forming, or a combination thereof. The film 120, 122 may be dampened and/or heated to increase the malleability thereof. The process may also involve the use of a vacuum to draw the film 120, 122 into a suitable mold. The vacuum drawing the film into the mold can be applied for about 0.2 to about 5 seconds, or about 0.3 to about 3, or about 0.5 to about 1.5 seconds, once the film is on the horizontal portion of the surface. This vacuum can be such that it provides an under-pressure in a range of 10 mbar to 1000 mbar, or in a range of 100 mbar to 600 mbar, for example.

The molds, in which cavities may be made, can have any shape, length, width and depth, depending on the required dimensions of the pouches 200. The molds may also vary in size and shape from one to another, if desirable. For example, the volume of the final pouches 200 may be from about 5 ml to about 300 ml, or about 10 ml to 150 ml, or about 15 ml to about 100 ml, or about 20 to about 40 ml, and that the mold sizes are adjusted accordingly.

The first film 120 may be formed into cavities that will form more than one compartment of a pouch. The compartments formed from the cavities are in a side-by-side or a 'tire and rim' orientation. The second film 122 may also comprise compartments, which may or may not comprise compositions. Alternatively, the second film may be a second closed pouch used to close the cavities that will form the multi-compartment pouch. The compartments of a multi-compartment pouch may be in a superposed orientation.

An exemplary means of making the webs 100 of the present disclosure is a continuous process for making a web, comprising the steps of:

a. continuously feeding a first water-soluble film 120 onto a horizontal portion of a continuously and rotatably moving endless surface, which comprises a plurality of molds, or onto a non-horizontal portion thereof and continuously moving the film 120 to said horizontal portion;

b. forming from the first film 120 on the horizontal portion of the continuously moving surface, and in the molds on the surface, a continuously moving, horizontally positioned web of open cavities;

c. filling the continuously moving, horizontally positioned web of open cavities with a composition, to obtain a horizontally positioned web of open, filled cavities;

d. closing the web of open, filled cavities, preferably continuously, to obtain closed pouches, preferably by feeding a second web, such as a second water-soluble film 122, onto the horizontally positioned web of open, filled cavities, to obtain closed pouches; and e. optionally, sealing the closed pouches to obtain a web 100 of closed pouches.

The second web, such as a second water-soluble film 122, may comprise at least one open or closed compartment 110.

A first web of open cavities may be combined with a second web of closed pouches preferably wherein the first and second webs are brought together and sealed together via a suitable means, and preferably wherein the second web is on a rotating drum set-up. In such a set-up, pouches are filled at the top of the drum and preferably sealed afterwards with a layer of film, the closed pouches come down to meet the first web comprising cavities, preferably open cavities, formed preferably on a horizontal forming surface. It has been found especially suitable to place the rotating drum unit above the horizontal forming surface unit. The cavities of the first web and/or the second web may be filled according to the steps described herein.

The processes of the present disclosure may include providing a plurality of modifications 150 to the seal region 140 of the web 100. The modifications 150 may be selected from perforations, indentations, and combinations thereof. The plurality of modifications may comprise perforations 152.

The modifications 150 may be made via laser perforation, ultra sound perforation, hot pin perforation, mechanical perforation, or any other suitable process.

The plurality of modifications may comprise perforations made with a laser, with an ultra sound device, with a mechanical device, or combinations thereof, preferably a laser. The plurality of modifications may comprise indentations made with a laser, with an ultra sound device, with a mechanical device, or combinations thereof, preferably an ultrasound device.

Suitable devices for making modifications 150 to the seal regions 140 of the web 100 include a laser device, an ultrasound device, a heating device, a mechanical device, or combinations thereof. Suitable mechanical devices include a blade, a punch, a needle, an embossing plate, or combinations thereof; the mechanical device may be heated, for example, hot pins. The mechanical devices may be organized and moved in any suitable fashion; for example, a plurality of devices (e.g., needles or pins) may move independently (e.g., up and down), may be located on a rotary drum, or may be located on a block. The drum or block may be sized, and its motion may be timed, to provide modifications at appropriate locations on the web as desired by the manufacturer.

The modifications 150 may be located at the seal region 140 but may not be located at the sealed compartments 110, 112, 114. In other words, the film 120, 122 and/or web 100 at the seal region 140 may comprise the modifications 150 (such as perforations 152), but the film 120, 122 and/or web 100 at the sealed compartment 110, 112, 114 may not comprise the modifications 150. When smaller side-by-side compartments are superposed on a larger compartment, it may not be preferable to modify/perforate the seal region between the side-by-side compartments, as doing so may affect the integrity of the larger compartments, which may be below the side-by-side compartments.

The sealed compartments 150 may have a periphery 142 adjacent the seal region 140. The modifications 150 may be located at least about 0.5 mm, or about 0.75 mm, or about 1 mm, or about 1.25 mm, from the periphery 142 of the sealed compartments 110. It is believed that the modifications 150 must be spaced a minimum distance from the compartments 110 so as not to impact the integrity of the sealed compartment 110, which might otherwise result in leakage of the composition 130 contained therein. The seal region 140 may include an unmodified area 144, which may be adjacent the compartment 110, and a modified area 146, which may be away from the compartment 110. To facilitate improved dissolution, the surface area of the modified area 146 may be greater than the surface area of the unmodified area of the seal region 140. The periphery 140 and/unmodified 144 may be located away from where the compartments 150 will be separated, e.g., the cut lines 102, 104, 106.

The modifications 150 may be located at least 0.1 mm, or at least 0.2 mm, apart from each other, as measured from the edge of one modification 150 (i.e., perforation 152) to the edge of another. The modifications 150 may be regularly spaced apart from each other. The modifications 150 may be made in a pattern, such as an aesthetic design, a picture, and/or a brand logo or name.

The modifications 150 may have an average maximum diameter of from about 0.2 mm to about 1 mm. The ratio of the average maximum diameter to the average distance apart may be from about 1:1.2 to about 1:5. Distances and diameters can be determined according to the test methods described below.

Figure 3:
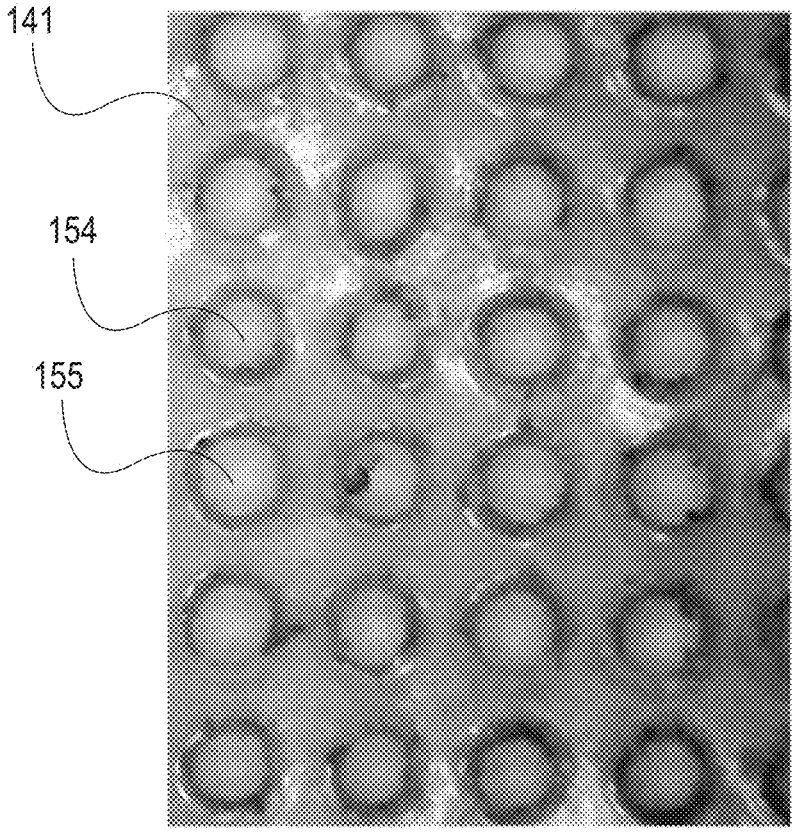
FIG. 3 shows a magnified view of a simulated seal region according to the present disclosure.

FIG. 3 shows a simulated seal region 141 at a magnification of 50×. Three layers of film 120, 122, 124 have been joined by solvent sealing. The simulated seal region 140 has been modified with perforations 154, 155. The distance from the center of a first perforation 154 to an adjacent second perforation 155 is approximately 0.7 mm. The diameter of the perforations 154, 155 is approximately 0.35 mm.

The process of the present disclosure may include separating the web 100 at the seal regions 140 to form a plurality of unitized dose pouches 200, for example by cutting. The web 100 may be separated, for example at cut lines 102, 104, 106, by any suitable means. For example, the web 100 may be cut by a sharp item (e.g., a blade), a hot item, or by a laser to form the plurality of unitized dose pouches. The cutting may be done in a continuous manner, and preferably with constant speed and preferably while in horizontal position.

Each pouch 200 may comprise at least one sealed compartment 110. Each pouch may comprise at least two, or at least three, sealed compartments 110, 112, 114. Each compartment 110, 112, 114 may contain a composition 130. The composition 130 in each compartment may be the same or different as the compositions in the other compartments.

The web 100 and/or unit dose articles 200 may be dusted with a dusting agent. Dusting agents can include talc, silica, zeolite, carbonate or mixtures thereof.

The films 120, 122, webs 100, and/or pouches 200 may be printed thereon by any suitable method. Typically, a printable material (e.g., ink) is applied to the water soluble film. The printing may be performed before or after the film is formed into a web or a pouch. The area of print may be achieved using standard techniques, such as flexographic printing or inkjet printing. The area of print may be achieved via flexographic printing, in which a film is printed, then moulded into the shape of an open compartment. This compartment may then be filled with a detergent composition and a second film placed over the compartment and sealed to the first film. The area of print may be on either or both sides of the film. Alternatively, an ink or pigment may be added during the manufacture of the film such that all or at least part of the film is coloured.

Water-Soluble Film

The present disclosure relates to webs formed from water-soluble film, for example a first film 120 joined to a second film 122.

The film of the present invention is soluble or dispersible in water. The water-soluble film preferably has a thickness of from 20 to 150 microns, preferably 35 to 125 microns, even more preferably 50 to 110 microns, most preferably from about 75 to about 85 microns.

Preferably, the film has a water-solubility of at least 50%, preferably at least 75% or even at least 95%, as measured by the method set out here after using a glass-filter with a maximum pore size of 20 microns:

5 grams±0.1 gram of film material is added in a preweighed 3 L beaker and 2 L±5 ml of distilled water is added. This is stirred vigorously on a magnetic stirrer, Labline model No. 1250 or equivalent and 5 cm magnetic stirrer, set at 600 rpm, for 30 minutes at 30° C. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the percentage solubility or dispersability can be calculated.

Preferred film materials are preferably polymeric materials. The film material can, for example, be obtained by casting, blow-moulding, extrusion or blown extrusion of the polymeric material, as known in the art.

Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%. The polymer can have any weight average molecular weight, preferably from about 1000 to 1,000,000, more preferably from about 10,000 to 300,000 yet more preferably from about 20,000 to 150,000.

Mixtures of polymers can also be used as the pouch material. This can be beneficial to control the mechanical and/or dissolution properties of the compartments or pouch, depending on the application thereof and the required needs. Suitable mixtures include for example mixtures wherein one polymer has a higher water-solubility than another polymer, and/or one polymer has a higher mechanical strength than another polymer. Also suitable are mixtures of polymers having different weight average molecular weights, for example a mixture of PVA or a copolymer thereof of a weight average molecular weight of about 10,000-40,000, preferably around 20,000, and of PVA or copolymer thereof, with a weight average molecular weight of about 100,000 to 300,000, preferably around 150,000. Also suitable herein are polymer blend compositions, for example comprising hydrolytically degradable and water-soluble polymer blends such as polylactide and polyvinyl alcohol, obtained by mixing polylactide and polyvinyl alcohol, typically comprising about 1-35% by weight polylactide and about 65% to 99% by weight polyvinyl alcohol. Preferred for use herein are polymers which are from about 60% to about 98% hydrolysed, preferably about 80% to about 90% hydrolysed, to improve the dissolution characteristics of the material.

Preferred films exhibit good dissolution in cold water, meaning unheated distilled water. Preferably such films exhibit good dissolution at temperatures of 24° C., even more preferably at 10° C. By good dissolution it is meant that the film exhibits water-solubility of at least 50%, preferably at least 75% or even at least 95%, as measured by the method set out here after using a glass-filter with a maximum pore size of 20 microns, described above.

Preferred films are those supplied by Monosol under the trade references M8630, M8900, M8779, and M8310.

Of the total PVA resin content in the film described herein, the PVA resin can comprise about 30 to about 85 wt % of the first PVA polymer, or about 45 to about 55 wt % of the first PVA polymer. For example, the PVA resin can contain about 50 w. % of each PVA polymer, wherein the viscosity of the first PVA polymer is about 13 cP and the viscosity of the second PVA polymer is about 23 cP.

Naturally, different film material and/or films of different thickness may be employed in making the compartments of the present invention. A benefit in selecting different films is that the resulting compartments may exhibit different solubility or release characteristics.

The film material herein can also comprise one or more additive ingredients. For example, it can be beneficial to add plasticisers, for example glycerol, ethylene glycol, diethyleneglycol, propylene glycol, sorbitol and mixtures thereof. Other additives may include water and functional detergent additives, including surfactant, to be delivered to the wash water, for example organic polymeric dispersants, etc.

The film may be opaque, transparent or translucent. The film may comprise a printed area. The printed area may comprise an ink, wherein the ink comprises a pigment. The ink for printing onto the film has preferably a desired dispersion grade in water. The ink may be of any color including white, red, and black. The ink may be a water-based ink comprising from 10% to 80% or from 20% to 60% or from 25% to 45% per weight of water. The ink may comprise from 20% to 90% or from 40% to 80% or from 50% to 75% per weight of solid.

The film may comprise an aversive agent, for example a bittering agent or capsaicin. Suitable bittering agents include, but are not limited to, naringin, sucrose octaacetate, quinine hydrochloride, denatonium benzoate, or mixtures thereof. Any suitable level of aversive agent may be used in or on the film. Suitable levels include, but are not limited to, 1 to 5000 ppm, or even 100 to 2500 ppm, or even 250 to 2000 rpm.

Compositions

The present disclosure relates to compositions 130. The compositions may be contained in the sealed compartments of the webs and/or unitized dose pouches described herein.

The pouches of the present disclosure may contain a composition 130, for example a household care composition. The composition can be selected from a liquid, solid or combination thereof. As used herein, "liquid" includes free-flowing liquids, as well as pastes, gels, foams and mousses. Non-limiting examples of liquids include light duty and heavy duty liquid detergent compositions, fabric enhancers, detergent gels commonly used for laundry, bleach and laundry additives. Gases, e.g., suspended bubbles, or solids, e.g. particles, may be included within the liquids. A "solid" as used herein includes, but is not limited to, powders, agglomerates, and mixtures thereof. Non-limiting examples of solids include: granules, microcapsules, beads, noodles, and pearlised balls. Solid compositions may provide a technical benefit including, but not limited to, through-the-wash benefits, pre-treatment benefits, and/or aesthetic effects.

The composition may be a household care composition, for example a household care composition selected from the group of light duty liquid detergents compositions, heavy duty liquid detergent compositions, hard surface cleaning compositions including hand dishwashing and automatic dishwashing compositions, detergent gels commonly used for laundry, bleaching compositions, laundry additives, fabric enhancer compositions, shampoos, body washes, other personal care compositions, and mixtures thereof. The composition is preferably a fabric care composition, such as liquid or powdered laundry detergent, or a hard surface cleaning composition, such as an automatic dishwashing composition.

In pouches or other articles comprising laundry, laundry additive and/or fabric enhancer compositions, the compositions may comprise one or more of the following non-limiting list of ingredients: fabric care benefit agent; detersive enzyme; deposition aid; rheology modifier; builder; bleach; bleaching agent; bleach precursor; bleach booster; bleach catalyst; perfume and/or perfume microcapsules; perfume loaded zeolite; starch encapsulated accord; polyglycerol esters; whitening agent; pearlescent agent; enzyme stabilizing systems; scavenging agents including fixing agents for anionic dyes, complexing agents for anionic surfactants, and mixtures thereof; optical brighteners or fluorescers; polymer including but not limited to soil release polymer and/or soil suspension polymer; dispersants; antifoam agents; non-aqueous solvent; fatty acid; suds suppressors, e.g., silicone suds suppressors; cationic starches; scum dispersants; substantive dyes; hueing dyes; colorants; opacifier; antioxidant; hydrotropes such as toluenesulfonates, cumenesulfonates and naphthalenesulfonates; color speckles; colored beads, spheres or extrudates; clay softening agents; anti-bacterial agents. Additionally or alternatively, the compositions may comprise surfactants, quaternary ammonium compounds, and/or solvent systems. Quaternary ammonium compounds may be present in fabric enhancer compositions, such as fabric softeners, and comprise quaternary ammonium cations that are positively charged polyatomic ions of the structure $NR_4^+$, where R is an alkyl group or an aryl group.

The compositions may comprise from about 1% to 80% by weight of a surfactant. Surfactant is particularly preferred as a component of the first composition. Preferably, the first composition comprises from about 5% to 50% by weight of surfactant. The second and third compositions may comprise surfactant at levels of from 0.1 to 99.9%. Detersive surfactants utilized can be of the anionic, nonionic, zwitterionic, ampholytic or cationic type or can comprise compatible mixtures of these types. More preferably surfactants are selected from the group consisting of anionic, nonionic, cationic surfactants and mixtures thereof.

The compositions may comprise a solvent system. The solvent system may contain water alone, organic solvents, or mixtures thereof. Preferred organic solvents include 1,2-propanediol, ethanol, glycerol, dipropylene glycol, methyl propane diol and mixtures thereof. Other lower alcohols, $C_1$-$C_4$ alkanolamines such as monoethanolamine and triethanolamine, can also be used.

The composition may comprise between about 0.5% and about 20%, or between about 0.5% and about 15%, preferably between about 0.5% and about 12%, more preferably between about 0.5% and about 10% by weight of the composition of water.

Unitized Dose Pouches

Figure 4:
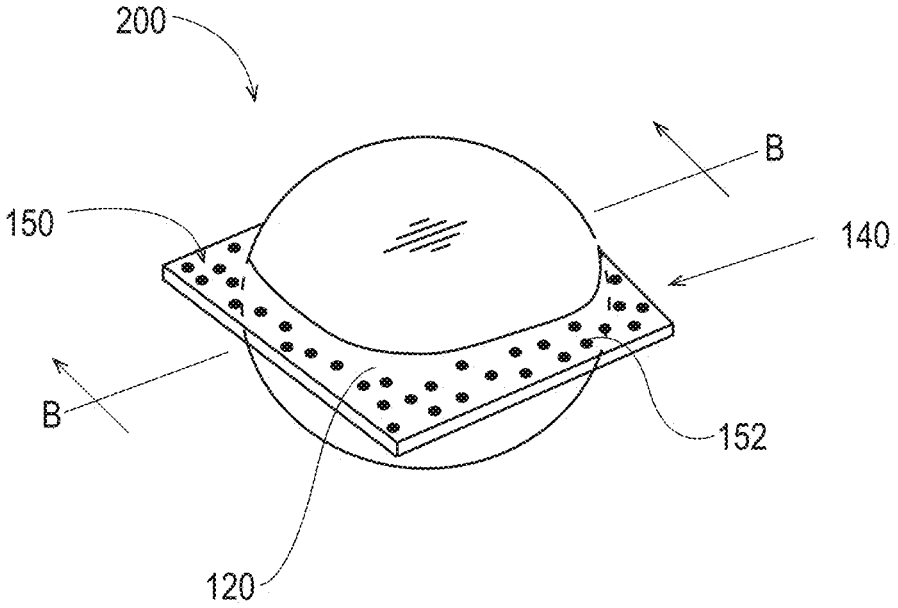
FIG. 4 shows a unit dose pouch according to the present disclosure.
Figure 5:
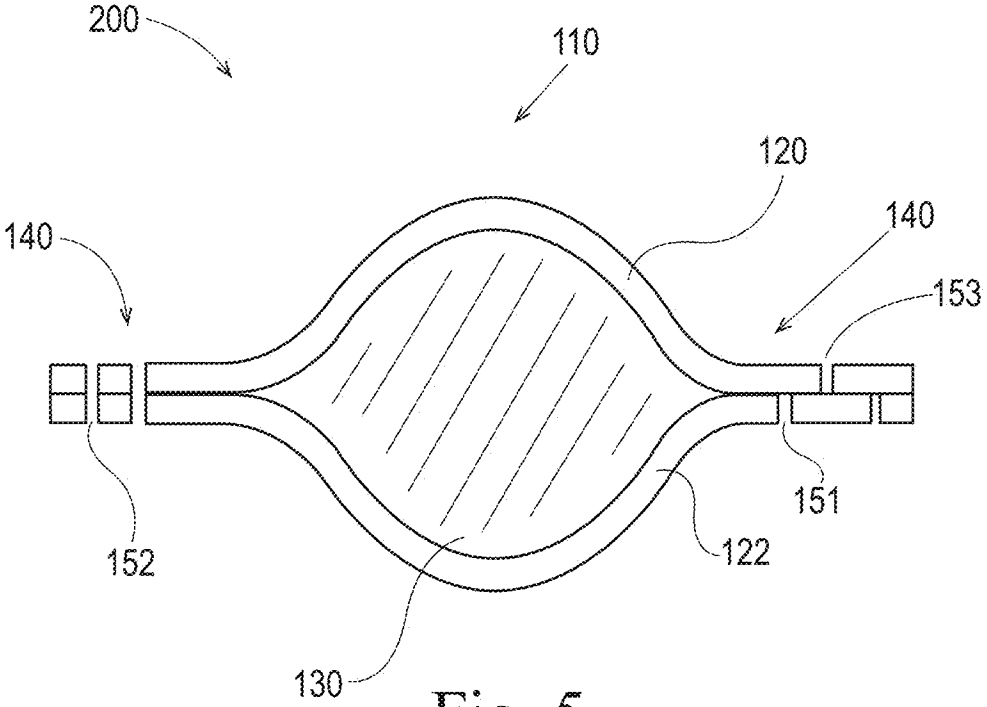
FIG. 5 shows a cross-sectional view of the unit dose pouch of FIG. 4, taken at line B-B.

The present disclosure relates to unitized dose pouches 200. The unitized dose pouches of the present disclosure may be formed by separating at least some of the sealed compartments 110, 112 of the webs 100 described herein. FIG. 4 shows a single-compartment unitized dose pouch 200 according to the present disclosure. FIG. 5 shows a cross-sectional view of the unitized dose pouch 200 of FIG. 4 as taken at line B-B.

The unitized dose pouches 200 may comprise at least a first water-soluble film 120 and a second water-soluble film 122 joined at a seal region 140 to form at least one compartment 130 therebetween, the at least one compartment 110 containing a composition 130, preferably a liquid composition, and the first and/or the second film 120, 122 comprising modifications 150 (e.g., perforations 152 and/or indentations, preferably perforations) at the seal region 140 and no modifications (e.g., no perforations and/or indentations, preferably no perforations) at the compartment 110. As shown in FIG. 5, at least some of the perforations 151, 153 may not traverse all layers of film 120, 122. The pouch 200 may comprise a third water-soluble film 124.

The pouches described herein provide convenient doses of a composition, such as a household care composition. Upon typically usage, the pouch is exposed to water, the film at least partially dissolves, and the composition contained in the compartment is released, for example released to a wash liquor.

Figure 6:
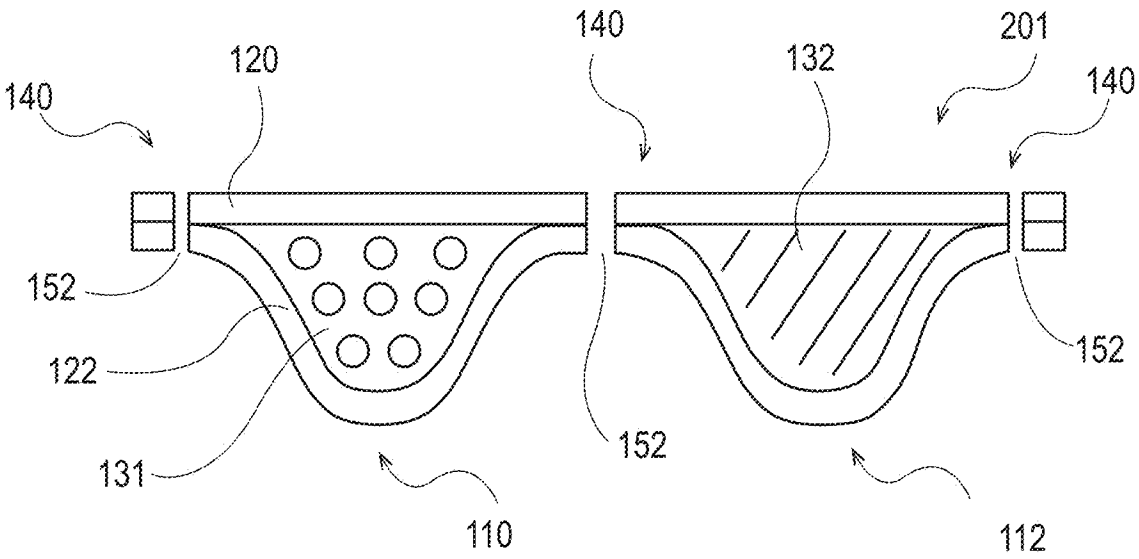
FIG. 6 shows a cross-sectional view of a unit dose pouch according to the present disclosure.
Figure 7:
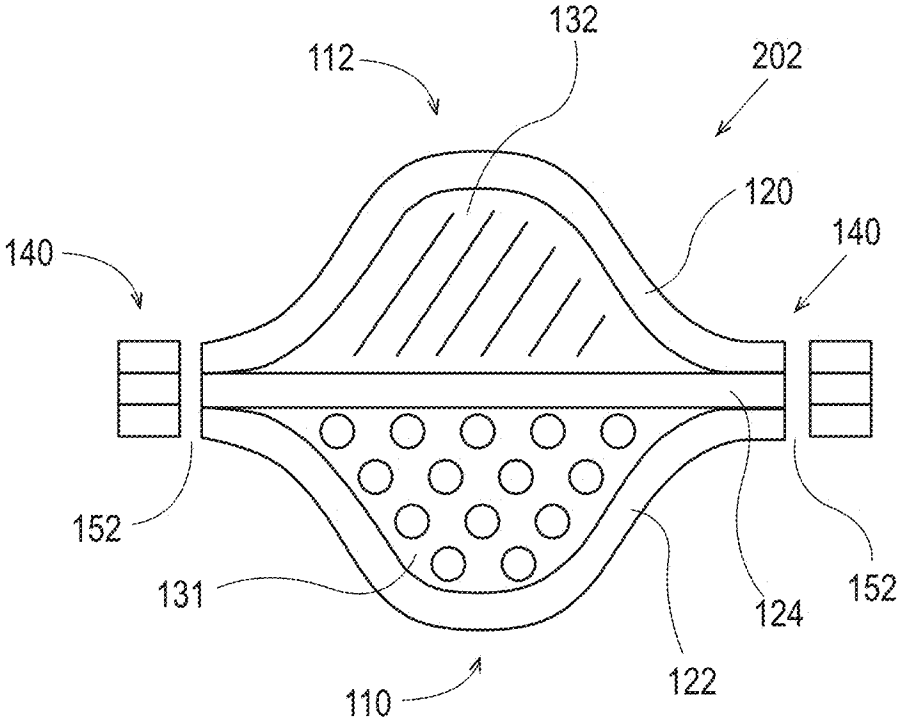
FIG. 7 shows a cross-sectional view of a unit dose pouch according to the present disclosure.

The unit dose pouch 200 may comprise more than one compartment, even at least two compartments, or even at least three compartments. As shown in the cross-sectional view of the unit dose pouch 201 of FIG. 6, the compartments 110, 112 may be positioned in a side-by-side orientation, i.e. one orientated next to the other. Each compartment 110, 112 may contain a different composition, for example a solid or granular composition 131 and a liquid composition 132, respectively. As shown in the cross-sectional view of the unit dose pouch 202 of FIG. 7, the compartments 110, 112 may be arranged in superposed orientation, i.e. one positioned on top of the other. The compartments may even be orientated in a 'tire and rim' arrangement, i.e. a first compartment is positioned next to a second compartment, but the first compartment at least partially surrounds the second compartment, but does not completely enclose the second compartment. Alternatively one compartment may be completely enclosed within another compartment. The pouches 200, 201, 202 of the present disclosure include modifications, such as perforations 152, at seal regions 140.

When the unit dose article 201, 202 comprises at least two compartments 110, 112, one of the compartments may be smaller than the other compartment. Wherein the unit dose article comprises at least three compartments, two of the compartments may be smaller than the third compartment, and preferably the smaller compartments are superposed on the larger compartment. The superposed compartments preferably are orientated side-by-side.

In a multi-compartment orientation, the composition 130 according to the present invention may be contained in at least one of the compartments 110. It may for example be contained in just one compartment 110, or may be contained in two compartments 110, 112, or even in three compartments 110, 112, 114.

The modifications 150 (e.g., perforations 152 and/or indentations) at the seal region 140 may be at least about 0.5 mm, or at least about 0.75 mm, or at least about 1.0 mm, or at least about 1.25 mm, apart from a periphery of the compartment. The perforations 152 may be located at least 0.1 mm, or at least about 0.5 mm, or at least about 1 mm, or at least about 1.5 mm, or at least about 2 mm, apart from each other.

Methods of Use

The present disclosure further relates to methods of using the pouches 200 described herein. For example, the present disclosure relates to a method of treating a substrate, such as a fabric.

The pouches 200 described herein, as well as compositions contained therein, may be used in methods to treat a substrate, e.g., fabric or a hard surface, for example by contacting the substrate with the film, article, and/or composition contained therein. The method may include the steps of combining the pouch 200 with water, allowing for at least some of the film 120, 122 of the pouch 200 to dissolve in the presence of water, diluting the composition contained therein 300-800 fold with water to form a wash liquor, and/or contacting the substrate, preferably a fabric, with the wash liquor; the substrate, preferably the fabric to be treated, may comprise one or more stains.

The contacting step may occur manually or in an automatic machine, e.g., an automatic (top or front-loading) laundry machine or an automatic dishwashing machine. The contacting step may occur in the presence of water, which may be at a temperature up to about 80° C., or up to about 60° C., or up to about 40° C., or up to about 30° C., or up to about 20° C., or up to about 15° C., or up to about 10° C., or up to about 5° C. As noted above, the present films and articles made therefrom are particularly suited for cold water dissolution and therefore provide benefits in cold-water washes (e.g., from about 1° C. to about 30° C., or from about 5° C. to about 20° C.). The contacting step may be followed by a multi-rinse cycle or even by a single rinse cycle; because the film has good dissolution properties, less water is required to dissolve the film and/or release the contents contained therein. Pouches according to the invention can also be used in evolving short wash or quick wash cycles, or even smart cycles where the machine adapts the wash cycle per the actual sensed wash conditions.

Combinations

Specifically contemplated combinations of the disclosure are herein described in the following lettered paragraphs. These combinations are intended to be illustrative in nature and are not intended to be limiting.

A. A process for making unitized dose pouches having improved water solubility, the process comprising the steps of: providing a web comprising at least a first water-soluble film and a second water-soluble film, the first and second water-soluble films being joined at seal regions, where the first film, the second film, and the seal regions define a plurality of sealed compartments, the sealed compartments containing at least one composition; providing a plurality of modifications to the seal region, the modifications being selected from perforations, indentations, and combinations thereof; and cutting the web at the seal regions to form a plurality of unitized dose pouches, each pouch comprising at least one sealed compartment.

B. A process for making unitized dose pouches according to paragraph A, the process further comprising the steps of providing the first film, forming a plurality of cavities in the first film, providing a composition to the plurality of cavities, and joining the second film to the first film to provide the web.

C. A process for making unitized dose pouches according to any of paragraphs A-B, wherein the at least one composition is a liquid or gel composition.

D. A process for making unitized dose pouches according to any of paragraphs A-C, wherein the at least one composition is a household care composition.

E. A process for making unitized dose pouches according to any of paragraphs A-D, wherein the at least one composition comprises from about 5% to about 60%, by weight of the at least one composition, of surfactant.

F. A process for making unitized dose pouches according to any of paragraphs A-E, wherein the plurality of sealed compartments comprise first compartments that contain a first composition, and wherein the plurality of sealed compartment further comprise second compartments that contain a second composition, where the second composition is different than the first composition.

G. A process for making unitized dose pouches according to any of paragraphs A-F, wherein the plurality of modifications comprise perforations.

H. A process for making unitized dose pouches according to any of paragraphs A-G, wherein the perforations are made with a laser, with an ultra sound device, with a mechanical device, or combinations thereof.

I. A process for making unitized dose pouches according to any of paragraphs A-H, wherein the perforations are made with a laser.

J. A process for making unitized dose pouches according to any of paragraphs A-I, wherein the modifications are made with an ultra sound device.

K. A process for making unitized dose pouches according to any of paragraphs A-J, wherein the ultra sound device is also used to join the first and second water-soluble films.

L. A process for making unitized dose pouches according to any of paragraphs A-K, wherein the modifications comprise indentations.

M. A process for making unitized dose pouches according to any of paragraphs A-L, wherein the modifications are located at the seal region but are not located at the sealed compartments.

N. A process for making unitized dose pouches according to any of paragraphs A-M, wherein the modifications are located at least 0.5 mm, on average, from a periphery of the sealed compartments.

O. A process for making unitized dose pouches according to any of paragraphs A-N, wherein the modifications are located at least 0.1 mm apart, on average, from each other.

P. A process for making unitized dose pouches according to any of paragraphs A-O, wherein the modifications are regularly spaced.

Q. A process for making unitized dose pouches according to any of paragraphs A-P, wherein the web further comprises a third water-soluble film.

R. A unitized dose pouch comprising at least a first water-soluble film and a second water-soluble film joined at a seal region to form at least one compartment therebetween, the at least one compartment containing a liquid composition, the first and/or the second film comprising perforations at the seal region and no perforations at the compartment.

S. A unitized dose pouch according to paragraph R, where the perforations are at least about 0.5 mm apart, on average, from a periphery of the compartment.

T. A unitized dose pouch according to any of paragraphs R-S, where the pouch comprises a third water-soluble film.

U. A unitized dose pouch according to any of paragraphs R-T, where the article comprises at least two compartments.

V. A unitized dose pouch according to any of paragraphs R-U, wherein the perforations are located at least 0.1 mm apart from each other on average.

W. A process of treating a fabric, the process comprising the steps of: providing a unitized dose pouch according to any of paragraphs S-V (or formed according to the processes of any of paragraphs A-Q); combining the pouch with water present in an amount sufficient to dissolve at least some of the film of the pouch, thereby releasing the liquid composition contained therein; and contacting a fabric with the liquid composition.

X. A process according to paragraph W, wherein the liquid composition is diluted about 300-fold to 800-fold with the water to form a wash liquor.

Y. A process according to any of paragraphs W-X, wherein the water is at a temperature of from about 1° C. to about 30° C.

Test Methods

Film Dissolution Test Method

To determine film dissolution, water-soluble film that includes an optical brightener is dissolved, and the amount of fluorescence (resulting from the optical brightener released into solution) is used to determine the relative dissolution of the film over time. The method is described in more detail below.

Figure 8:
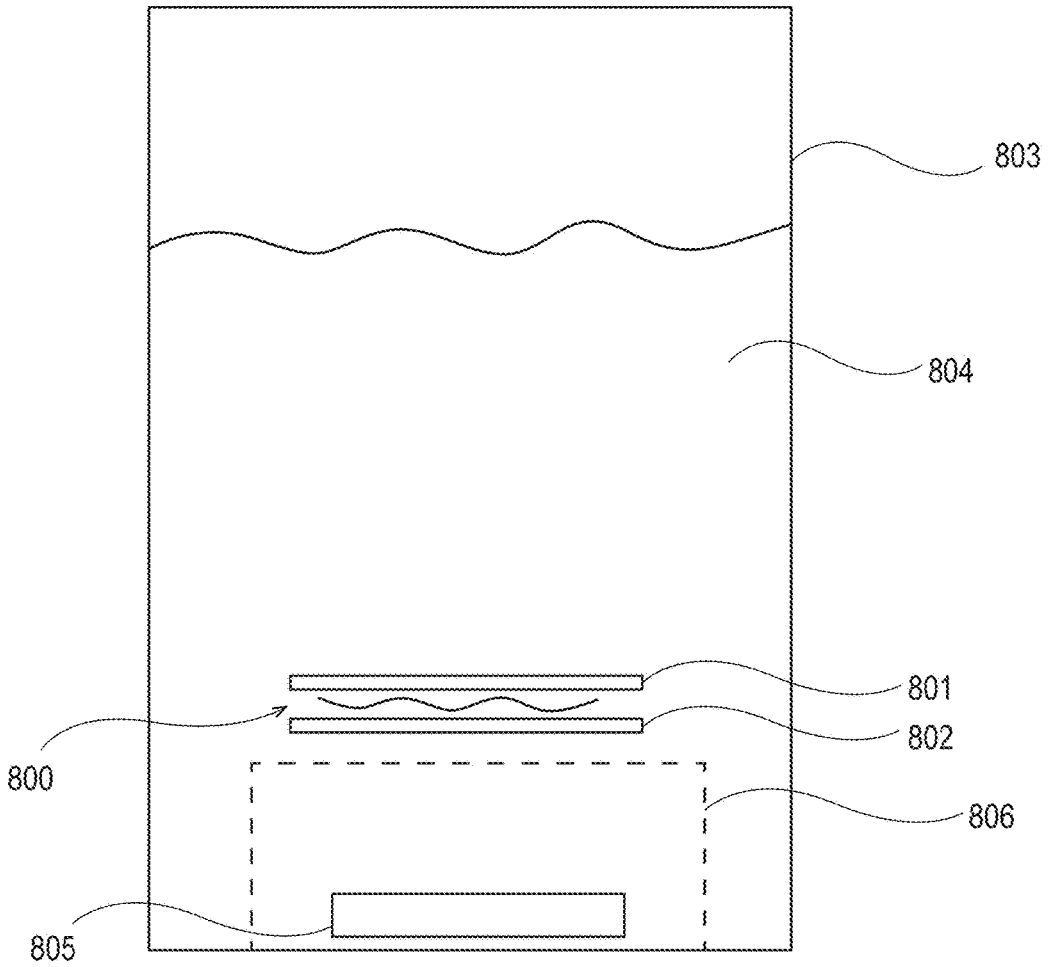
FIG. 8 shows a schematic diagram of the experimental set-up for the Film Dissolution Test Method.

Film samples (e.g., PVOH film) that include an optical brightener (Tinopal CBS-X, available from BASF) at a concentration of 1000 ppm are provided. As schematically shown in FIG. 8, a sample of film 800 (30 mm×15 mm) is clamped in a sample holder between two layers of 200 gauge wire mesh 801, 802 to keep it in place during the test.

The sample holder is placed in a container 803 with 4 L of demineralized water 804 at 20° C. A magnetic stirrer 805 with a speed of about 60-100 rpm is used to ensure homogenization of the solution. The sample holder is placed on a coarse (1 cm) wire mesh 806 support to prevent contact between the sample 800 and the stirrer 805.

Over time, the film dissolves in the water to form a solution ("film solution"). Samples of the film solution are taken with a syringe every 30 seconds for the first 5 minutes, and every 1 minute thereafter, until the film has fully dissolved.

The fluorescence of the samples of the film solution are measured in a fluorimeter (Perkin Elmer LS55) with an excitation wave length of 350 nm and emission wave length of 430 nm. Fluorescence is measured for time t and compared to the end value (equilibrium at full dissolution)

A dissolution curve is constructed as % of dissolved film vs. time t according to the following equation:

$$\text{Dissolution \% at time } t = [\text{fluo}(t) - \text{fluo(initial)}]/[\text{fluo(end)} - \text{fluo(initial)}] \times 100\%$$

Determination of Perforation Size and/or Distance Between Perforations

The average size of the perforations and/or the distance between perforations can be measured with an optical microscope (for example, a Dino Lite AM4113T) and suitable image analysis software (example: "Dino Capture 2.0"). For each determination, measurements for five randomly selected perforations (or the distances between five pairs of adjacent perforations, selected at random) are taken and averaged by the system.

EXAMPLES

The examples provided below are intended to be illustrative in nature and are not intended to be limiting.

Example 1. Dissolution Comparison—Three Film Layers

To simulate the seal region of a unitized dose pouch, PVOH film laminates were produced by bonding three layers of PVOH film, each of which had a thickness of about 76 μm. The films were bonded by solvent (water) sealing.

One of the samples ("3-layer seal reference") had no further treatment.

The second sample ("3-layer seal with perforation") was perforated using a laser beam, with a perforation pattern having a square arrangement as shown in FIG. 3.

Figure 9:
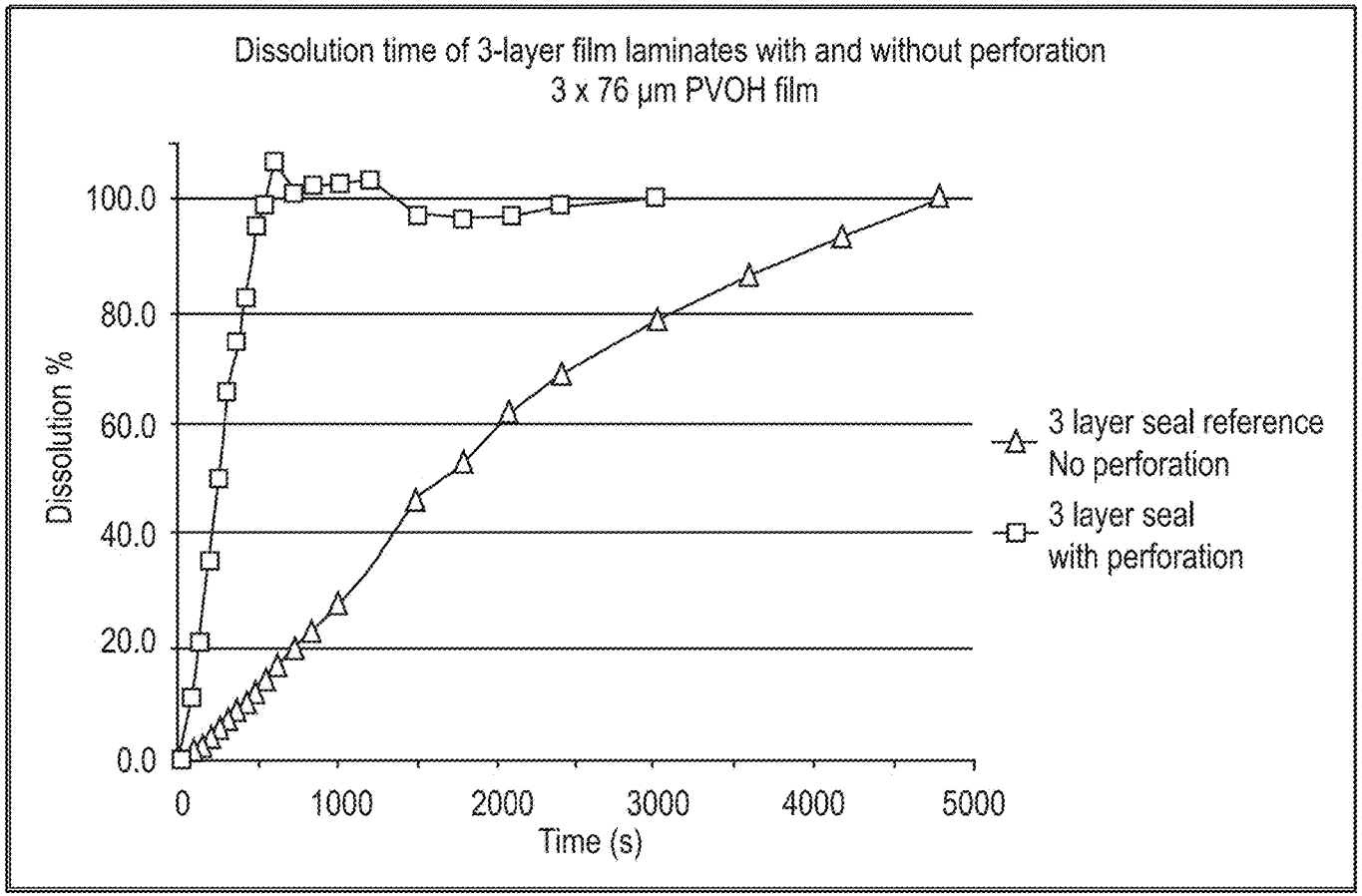
FIG. 9 is a graph showing the results from the comparison described in Example 1.

The dissolution of each sample was determined according to the Film Dissolution Test Method described above. The results are shown in FIG. 9. As can be seen in FIG. 9, the 3-layer seal with perforation had a greater rate of dissolution and reached complete (100%) dissolution more quickly than the 3-layer seal reference.

Example 2. Dissolution Comparison—Two Film Layers

The following test was conducted in a manner similar to that of Example 1. In this case, PVOH film laminates were produced by bonding two layers of PVOH film, each of which had a thickness of about 76 μm. The films were bonded by solvent (water) sealing.

One sample was a reference sample, having no perforations.

The other two samples were perforated with a rectangular perforation pattern, with the perforations having a center-center spacing of about 1 mm and a perforation diameter of about 0.5 mm.

For one of perforated samples, the perforation was done after the two layers were sealed together ("perforation after sealing"). In the other perforated sample, the films were perforated before they were sealed together ("perforation of individual layers before sealing").

Figure 10:
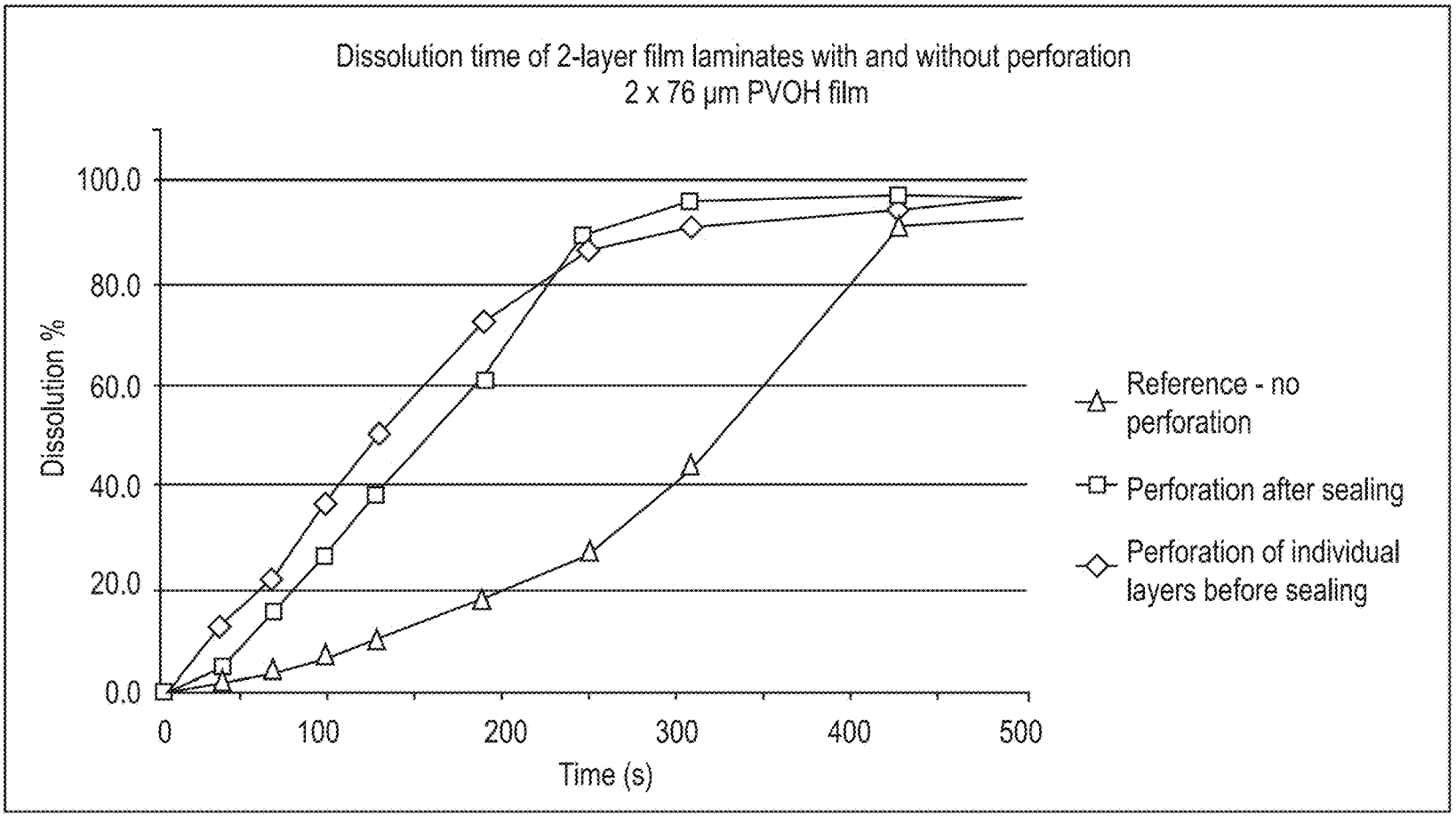
FIG. 10 is a graph showing the results from the comparison described in Example 2.

The dissolution of each sample was determined according to the Film Dissolution Test Method described above. The results are shown in FIG. 10. As can be seen in FIG. 10, both perforated samples showed significantly faster dissolution compared to the unperforated reference. Additionally, there was no significant difference between the two perforated samples, indicating that the sequence of the two operations (sealing/bonding and perforation) has little effect on dissolution. However, it may be preferable to seal/bond prior to perforation for the reasons described above.

Example 3. Composition Formulations

Tables 1-2 show illustrative compositions that may contained in the pouches described herein. For example, the compositions below, which are intended to be non-limiting examples, may be encapsulated in the water-soluble films described herein, where the seal region of the pouch is perforated.

Granular laundry detergents can include the ingredients presented in Table 1.

TABLE 1

| | A (wt %) | B (wt %) | C (wt %) | D (wt %) | E (wt %) | F (wt %) |
|---|---|---|---|---|---|---|
| Linear alkylbenzenesulfonate | 8 | 7.1 | 7 | 6.5 | 7.5 | 7.5 |
| AE3S | 0 | 4.8 | 0 | 5.2 | 4 | 4 |
| C12-14 Alkylsulfate | 1 | 0 | 1 | 0 | 0 | 0 |
| AE7 | 2.2 | 0 | 3.2 | 0 | 0 | 0 |
| $C_{10-12}$ Dimethyl hydroxyethylammonium chloride | 0.75 | 0.94 | 0.98 | 0.98 | 0 | 0 |
| Crystalline layered silicate (δ-$Na_2Si_2O_5$) | 4.1 | 0 | 4.8 | 0 | 0 | 0 |
| Zeolite A | 5 | 0 | 5 | 0 | 2 | 2 |
| Citric Acid | 3 | 5 | 3 | 4 | 2.5 | 3 |
| Sodium Carbonate | 15 | 20 | 14 | 20 | 23 | 23 |
| Silicate 2R ($SiO_2$:$Na_2O$ at ratio 2:1) | 0.08 | 0 | 0.11 | 0 | 0 | 0 |
| Soil release agent | 0.75 | 0.72 | 0.71 | 0.72 | 0 | 0 |
| Acrylic Acid/Maleic Acid Copolymer | 1.1 | 3.7 | 1.0 | 3.7 | 2.6 | 3.8 |
| Carboxymethylcellulose | 0.15 | 1.4 | 0.2 | 1.4 | 1 | 0.5 |
| Protease - Purafect ® (84 mg active/g) | 0.2 | 0.2 | 0.3 | 0.15 | 0.12 | 0.13 |
| Amylase - Stainzyme Plus ® (20 mg active/g) | 0.2 | 0.15 | 0.2 | 0.3 | 0.15 | 0.15 |
| Lipase - Lipex ® (18.00 mg active/g) | 0.05 | 0.15 | 0.1 | 0 | 0 | 0 |
| Amylase - Natalase ® (8.65 mg active/g) | 0.1 | 0.2 | 0 | 0 | 0.15 | 0.15 |
| Cellulase - Celluclean ™ (15.6 mg active/g) | 0 | 0 | 0 | 0 | 0.1 | 0.1 |
| TAED | 3.6 | 4.0 | 3.6 | 4.0 | 2.2 | 1.4 |
| Percarbonate | 13 | 13.2 | 13 | 13.2 | 16 | 14 |
| Na salt of Ethylenediamine-N,N'-disuccinic acid, (S,S) isomer (EDDS) | 0.2 | 0.2 | 0.2 | 0.2 | 0.2 | 0.2 |
| Hydroxyethane di phosphonate (HEDP) | 0.2 | 0.2 | 0.2 | 0.2 | 0.2 | 0.2 |
| $MgSO_4$ | 0.42 | 0.42 | 0.42 | 0.42 | 0.4 | 0.4 |
| Perfume | 0.5 | 0.6 | 0.5 | 0.6 | 0.6 | 0.6 |
| Suds suppressor agglomerate | 0.05 | 0.1 | 0.05 | 0.1 | 0.06 | 0.05 |
| Soap | 0.45 | 0.45 | 0.45 | 0.45 | 0 | 0 |
| Sulphonated zinc phthalocyanine (active) | 0.0007 | 0.0012 | 0.0007 | 0 | 0 | 0 |
| S-ACMC | 0.01 | 0.01 | 0 | 0.01 | 0 | 0 |
| Direct Violet 9 (active) | 0 | 0 | 0.0001 | 0.0001 | 0 | 0 |
| Sulfate/Water & Miscellaneous | | | Balance to 100 | | | |

Multi-compartment pouches can contain a plurality of benefit agents. By way of a non-limiting example, a two- or three-component pouch may contain the formulations presented in Table 2 in separate compartments, where dosage is the amount of the formulation in the respective enclosure. At least one of the compartments contains a liquid composition. Any of the compositions in any of the compartments below may be present in any combination in a pouch, or may even be individually presented, e.g., in a mono-compartment pouch

TABLE 2

| | G 3 compartments | | | H 2 compartments | | I 3 compartments | | |
|---|---|---|---|---|---|---|---|---|
| Compartment # | 1 | 2 | 3 | 1 | 2 | 1 | 2 | 3 |
| Dosage (g) | 34.0 | 3.5 | 3.5 | 30.0 | 5.0 | 25.0 | 1.5 | 4.0 |
| Ingredients | | | | Weight % | | | | |
| Alkylbenzene sulfonic acid | 20.0 | 20.0 | 20.0 | 10.0 | 20.0 | 20.0 | | |
| Alkyl sulfate | | | | 2.0 | | | | |
| C12-14 alkyl 7-ethoxylate | 17.0 | 17.0 | 17.0 | | 17.0 | 17.0 | | |
| Cationic surfactant | | | | 1.0 | | | | |
| Zeolite A | | | | 10.0 | | | | |
| C12-18 Fatty acid | 13.0 | 13.0 | 13.0 | | 18.0 | 18.0 | | |
| Sodium acetate | | | | 4.0 | | | | |
| enzymes | 0-3 | 0-3 | 0-3 | 0-3 | | 0-3 | | |
| Sodium Percarbonate | | | | 11.0 | | | | |
| TAED | | | | 4.0 | | | | |
| Organic catalyst [1] | | | | 1.0 | | | | |
| PAP granule [2] | | | | | | | | |

TABLE 2-continued

| | G 3 compartments | | | H 2 compartments | | I 3 compartments | |
|---|---|---|---|---|---|---|---|
| Polycarboxylate | | | | 1.0 | | | |
| Polyethyleneimine ethoxylate [3] | 2.2 | 2.2 | 2.2 | | | | |
| Hydroxyethane diphosphonic acid | 0.6 | 0.6 | 0.6 | 0.5 | | | |
| Ethylene diamine tetra(methylene phosphonic) acid | | | | | | 0.4 | |
| Brightener | 0.2 | 0.2 | 0.2 | 0.3 | | 0.3 | |
| Mineral oil | | | | | | | |
| Hueing dye [4] | | | 0.05 | | 0.035 | | 0.12 |
| Perfume | 1.7 | 1.7 | | 0.6 | | 1.5 | |
| Water and minors (antioxidant, aesthetics, . . .) | 10.0 | 10.0 | 10.0 | 4.0 | | | |
| Buffers (sodium carbonate, monoethanolamine) [5] | To pH 8.0 for liquids<br>To RA > 5.0 for powders | | | | | | |
| Solvents (1,2 propanediol, ethanol) for liquids, sodium sulfate for powders | To 100% | | | | | | |

[1] Sulfuric acid mono-[2-(3,4-dihydro-isoquinolin-2-yl)-1-(2-ethyl-hexyloxymethyl)-ethyl]ester as described in U.S. Pat. No. 7,169,744

[2] PAP = Phtaloyl-Amino-Peroxycaproic acid, as a 70% active wet cake

[3] Polyethylenimine (MW = 600) with 20 ethoxylate groups per —NH.

[4] Ethoxylated thiophene, EO ($R_1$ + $R_2$) = 5

[5] RA = Reserve Alkalinity (g NaOH/dose)

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process for making unitized dose pouches having improved water solubility, the process comprising the steps of:

providing a web comprising at least a first water-soluble film and a second water-soluble film, the first and second water-soluble films being joined at seal regions, where the first film, the second film, and the seal regions define a plurality of sealed compartments, the sealed compartments containing at least one composition;

providing a plurality of modifications solely to the seal region, the modifications comprising perforations; and cutting the web along cut lines at the seal regions and separating the web along the cut lines to form a plurality of unitized dose pouches, each pouch comprising at least one sealed compartment, a seal region, and modifications at the seal region of the pouch.

2. A process for making unitized dose pouches according to claim 1, the process further comprising the steps of providing the first film, forming a plurality of cavities in the first film, providing a composition to the plurality of cavities, and joining the second film to the first film to provide the web.

3. A process for making unitized dose pouches according to claim 1, wherein the at least one composition is a liquid or gel composition.

4. A process for making unitized dose pouches according to claim 1, wherein the at least one composition comprises from about 5% to about 60%, by weight of the at least one composition, of surfactant.

5. A process for making unitized dose pouches according to claim 1, wherein the plurality of sealed compartments comprise first compartments that contain a first composition, and wherein the plurality of sealed compartment further comprise second compartments that contain a second composition, where the second composition is different than the first composition.

6. A process for making unitized dose pouches according to claim 1, wherein the perforations are made with a laser, with an ultra sound device, with a mechanical device, or combinations thereof.

7. A process for making unitized dose pouches according to claim 6, wherein the perforations are made with a laser.

8. A process for making unitized dose pouches according to claim 1, wherein the modifications are located at least 0.5 mm, on average, from a periphery of the sealed compartments.

9. A process for making unitized dose pouches according to claim 1, wherein the modifications are located at least 0.1 mm apart, on average, from each other.

10. A process for making unitized dose pouches according to claim 1, wherein the modifications are regularly spaced.

11. A process for making unitized dose pouches according to claim 1, wherein the web further comprises a third water-soluble film.

* * * * *